US006457685B1

(12) United States Patent
Taylor

(10) Patent No.: US 6,457,685 B1
(45) Date of Patent: Oct. 1, 2002

(54) PORTABLE BOW AND LONG GUN HOLDER

(76) Inventor: John F. Taylor, 2840 N. River Rd., Saginaw, MI (US) 48609

( * ) Notice: Subject to any disclaimer, the term of this patent is extended or adjusted under 35 U.S.C. 154(b) by 0 days.

(21) Appl. No.: 09/645,024

(22) Filed: Aug. 23, 2000

(51) Int. Cl.[7] ..... F16M 11/38

(52) U.S. Cl. ..... 248/166; 248/176.3; 248/231.61; 124/41.1; 124/44.5

(58) Field of Search ..... 248/231.61, 176.1, 248/176.3, 170, 166, 434, 435; 211/64; 124/23.1, 24.1, 27, 41.1, 44.5

(56) References Cited

U.S. PATENT DOCUMENTS

| | | | | |
|---|---|---|---|---|
| 329,140 | A | * | 10/1885 | Clarke |
| 3,256,872 | A | | 6/1966 | Koser |
| 3,361,265 | A | * | 1/1968 | Wernimont |
| 3,584,820 | A | | 6/1971 | Butcher, Sr. |
| 4,131,202 | A | * | 12/1978 | Hansen |
| 4,271,813 | A | * | 6/1981 | Rowe |
| 4,331,311 | A | | 5/1982 | Russell |
| 4,360,179 | A | | 11/1982 | Roberts |
| 4,474,296 | A | | 10/1984 | Hartman |
| 4,542,873 | A | | 9/1985 | Matherly |
| 4,696,461 | A | * | 9/1987 | Zelinski |
| 4,729,363 | A | | 3/1988 | Skyba |
| 4,936,531 | A | * | 6/1990 | Bauser |
| 4,993,398 | A | | 2/1991 | Wallace |
| 5,044,590 | A | | 9/1991 | Carafice |
| 5,048,504 | A | | 9/1991 | Ballard |
| 5,186,276 | A | | 2/1993 | Craig |
| 5,452,703 | A | * | 9/1995 | Bateman, III |
| 5,482,241 | A | | 1/1996 | Oglesby |
| 5,619,981 | A | | 4/1997 | Breedlove |
| 5,626,379 | A | | 5/1997 | Scott |
| 5,775,658 | A | | 7/1998 | Englehardt |
| 5,819,462 | A | | 10/1998 | Dockery |
| 6,012,439 | A | | 1/2000 | Woodruff |
| 6,029,386 | A | | 2/2000 | Globig |
| 6,032,911 | A | | 3/2000 | Osborne |

* cited by examiner

*Primary Examiner*—Korie Chan
(74) *Attorney, Agent, or Firm*—Reising, Ethington, Barnes, Kisselle, Learman & McCulloch, P.C.

(57) ABSTRACT

The portable bow and long gun holder has a base plate and an upright connected to the base plate by a hinge. A weapon bottom end holder is provided on the base plate rear end. A weapon upper holder assembly with bow engaging surfaces and a gun barrel engaging surface is attached to an upper end of the upright. A lock assembly holds the upright in a weapon support position or frees the upright to pivot to a transport position parallel with the base. Outriggers are clamped to the upright in ground engaging positions to provide lateral stability. An arrow cutout in one side of the upright permits an arrow to be attached to a bow supported by the holder. The upright is reversible to change the position of the arrow cutout. The weapon upper holder is also reversible. A tree stand clamp clamps the base plate to the tree stand.

11 Claims, 3 Drawing Sheets

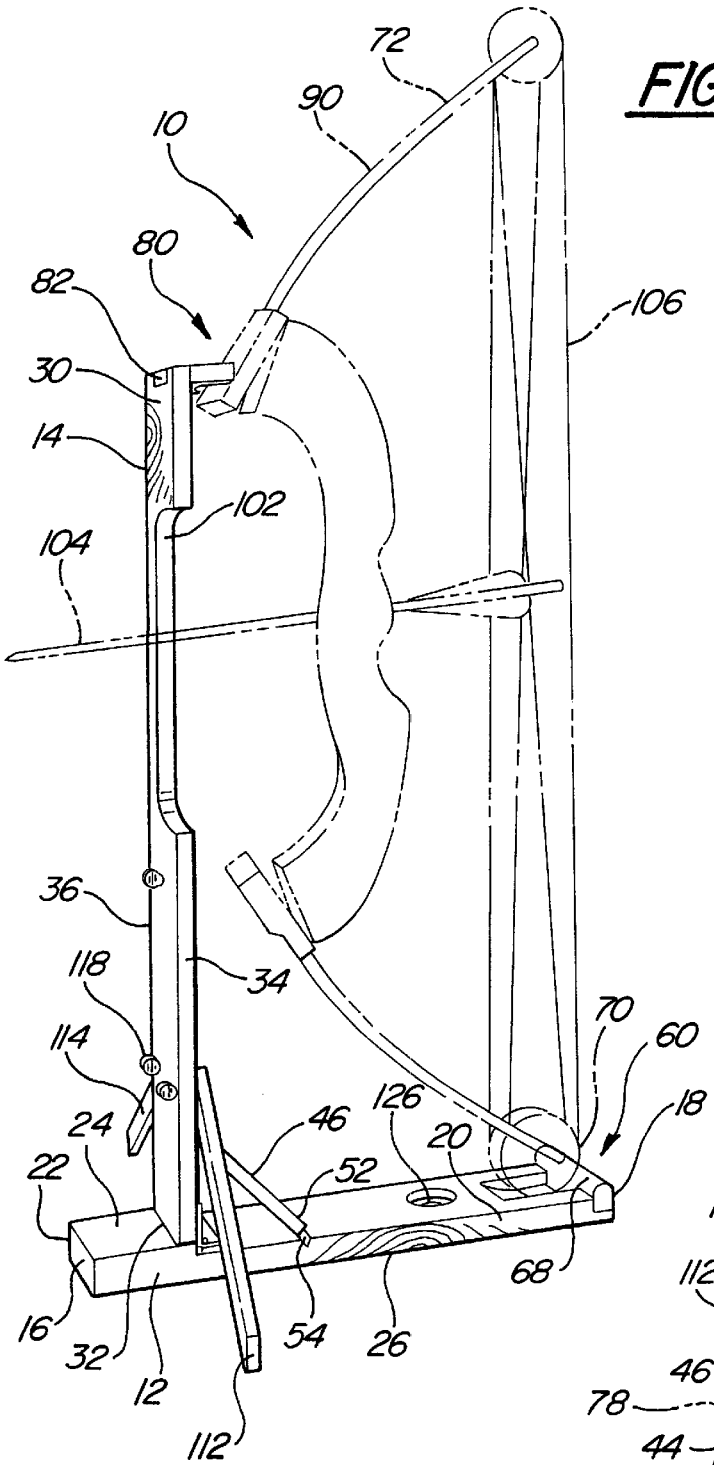
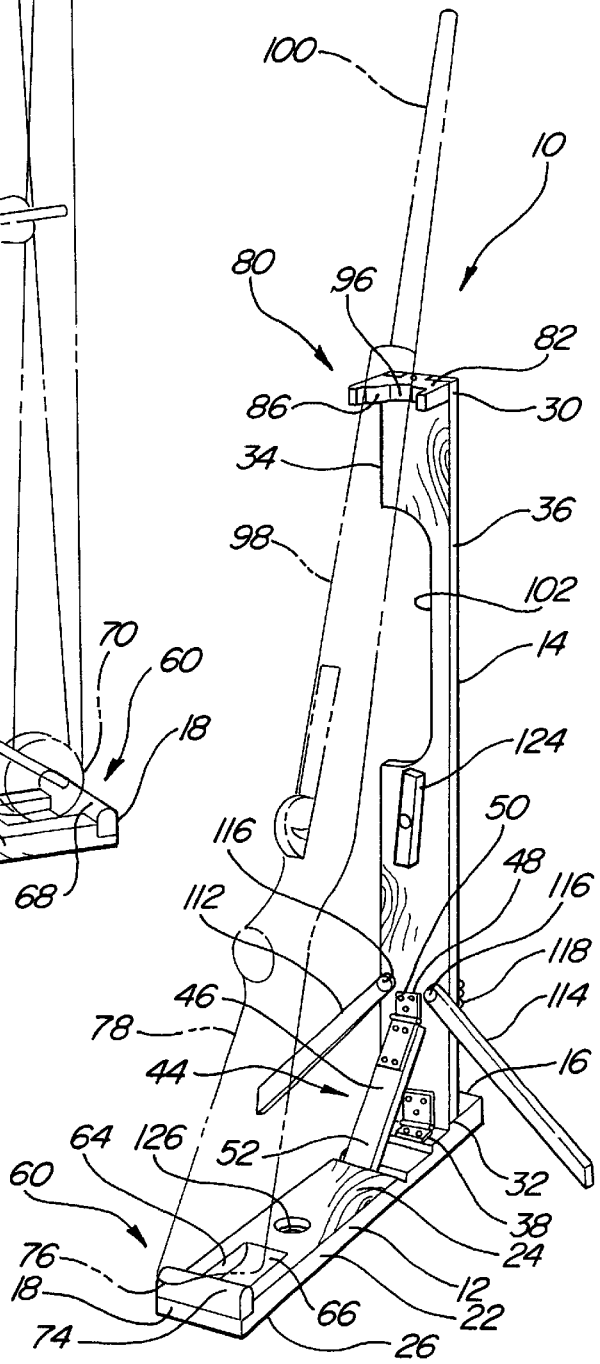
FIG-2

PORTABLE BOW AND LONG GUN HOLDER

TECHNICAL FIELD

The portable bow and long gun holder holds a bow or a long gun for a hunter in a hunting blind or a tree stand and folds into a small package to carry into and out of a hunting area.

BACKGROUND OF THE INVENTION

Hunters set on tree stands and in hunting blinds for hours waiting for game to come within range of their weapons. Holding a weapon for long periods of time is tiring. After supporting the weight of a weapon for some period of time, a hunter's muscles tire and lose their ability to hold a weapon steady while aiming at prey. The length of time a weapon can be held before muscle fatigue becomes a problem depends on a number of factors including the physical condition of the hunter, the weight of the weapon, weather conditions and the hunting area.

Hunters generally try to keep their weapons clean, dry and in good condition for use. They do not like to lay them down in mud or on wet surfaces. Dust and sandy surfaces are also avoided especially if the weapon has moving parts that can be damaged or prevented from functioning properly by dust or sand. Hard surfaces such as rocks can damage weapons and are therefore also to be avoided.

Weapons that are held by a holder need to be close to a hunter and generally in a position which minimizes the movement required to place them in a position to be used. Game can often detect movement at substantial distances and can be scared away if movement is detected. A hunter should be able to reach his weapon with hand and arm movement only. Minimal addition movement should be required to move the weapon to a proper use position.

Noise can also alert prey. A weapon holder should therefore minimize the possibility of making excessive noise when the weapon is removed from the holder. The holder should also remain in a position for use and not fall over when the weapon is removed.

A number of weapon holders, that have been proposed in the past, require parts to be fixed to the weapon. These parts that connect to the weapon are generally undesirable. They add weight and in some cases require permanent modification of the weapon. Such modifications of a weapon may interfere with proper functioning of the weapon. Anything that is attached to a weapon can catch on objects such as vines, tree limbs and other vegetation when carrying the weapon into a hunting area. These attachments may also catch on a hunter's clothes or other equipment.

Weapon holders have also been proposed that include structures that penetrate into the ground. If the ground is rock of even just hard soil, it may not be possible to obtain the required penetration. Hunting areas with sandy soils and other soft soils may not hold a weapon holder upright even when embedded in the soil the maximum intended distance.

SUMMARY OF THE INVENTION

The portable bow and long gun holder has a base plate with a forward end, a rear end, a fore and aft center line and a top surface, and an upright with an upper end, a lower end, a left side and a right side. A hinge pivotally attaches the lower end of the upright to the base plate adjacent to the forward end for pivotal movement between a weapon support position and a transport position in which the upright is generally parallel to the base plate. A weapon bottom end holder on the rear end of the base plate includes a pair of spaced apart side walls on opposite sides of the fore and aft center line and a bottom end wall that is transverse to the fore and aft center line and faces toward the hinge. A weapon upper holder on an upper end of the upright has pair of bow engaging surfaces and a gun barrel engaging surface between the pair of bow engaging surfaces. A lock releasably holds the upright in the weapon support position.

A cutout in one side of the upright provides an arrow passage. The upright is reversible to shift the cutout from one side to another to accommodate both right handed and left handed hunters. The weapon upper holder is also reversible.

Outriggers are clamped to the upright to provide lateral stability.

BRIEF DESCRIPTION OF THE DRAWINGS

The presently preferred embodiment of the invention is disclosed in the following description and in the accompanying drawings, wherein:

FIG. 1 is a perspective view of the portable bow and long gun holder holding a bow;

FIG. 2 is a perspective view of the portable bow and long gun holder holding a long gun;

DETAILED DESCRIPTION OF THE PREFERRED EMBODIMENT

Figure 3:
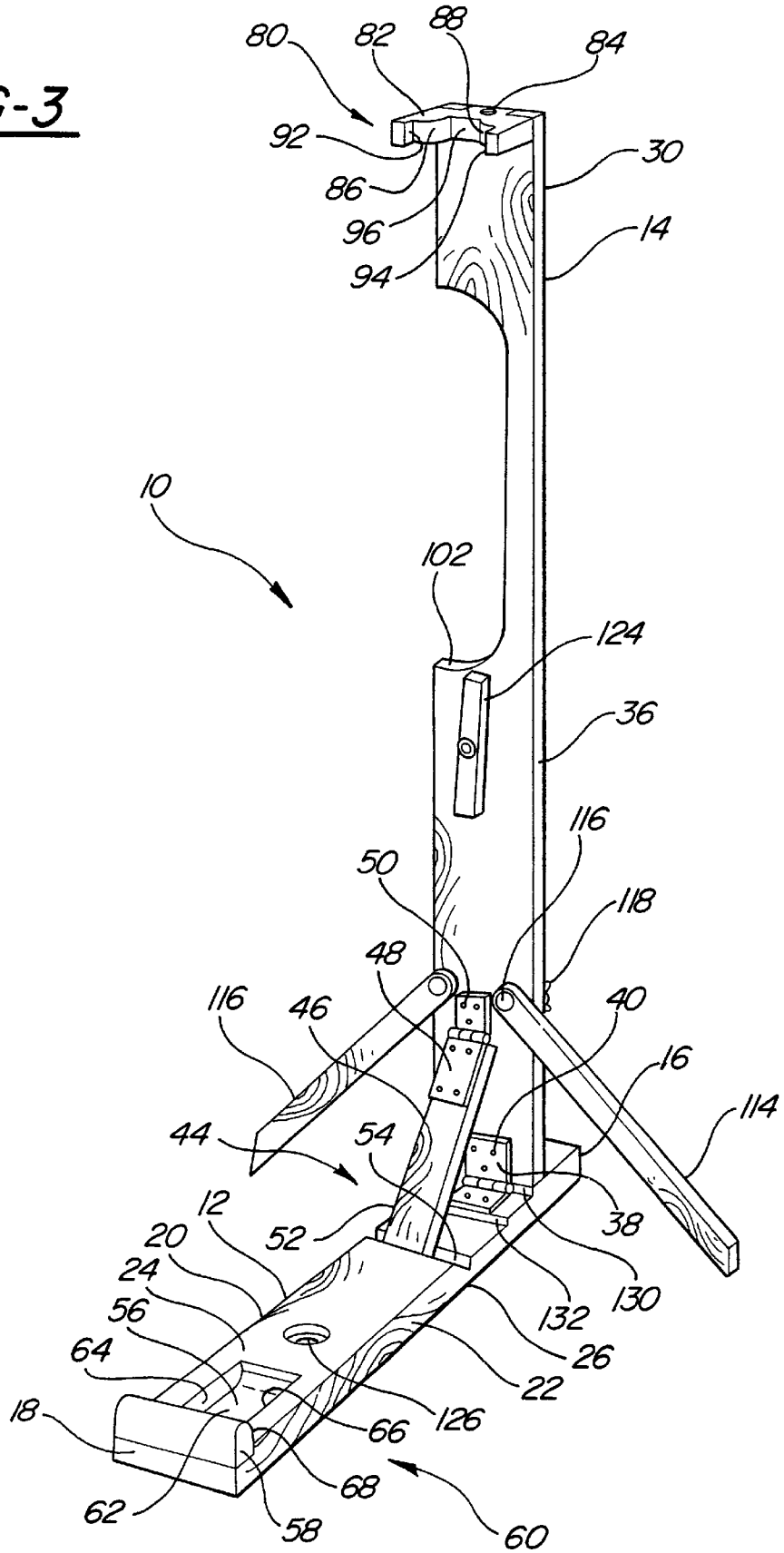
FIG. 3 is a perspective view of the portable bow and long gun holder in a weapon support position.

The portable bow and long gun holder 10 as seen in the drawing is made from wood with metal hinges and fasteners. The portable weapon holder 10 could also be made from metal or from plastic materials. High friction cushioning surfaces of rubber of similar material can also be employed with metal or plastic parts.

Figure 4:
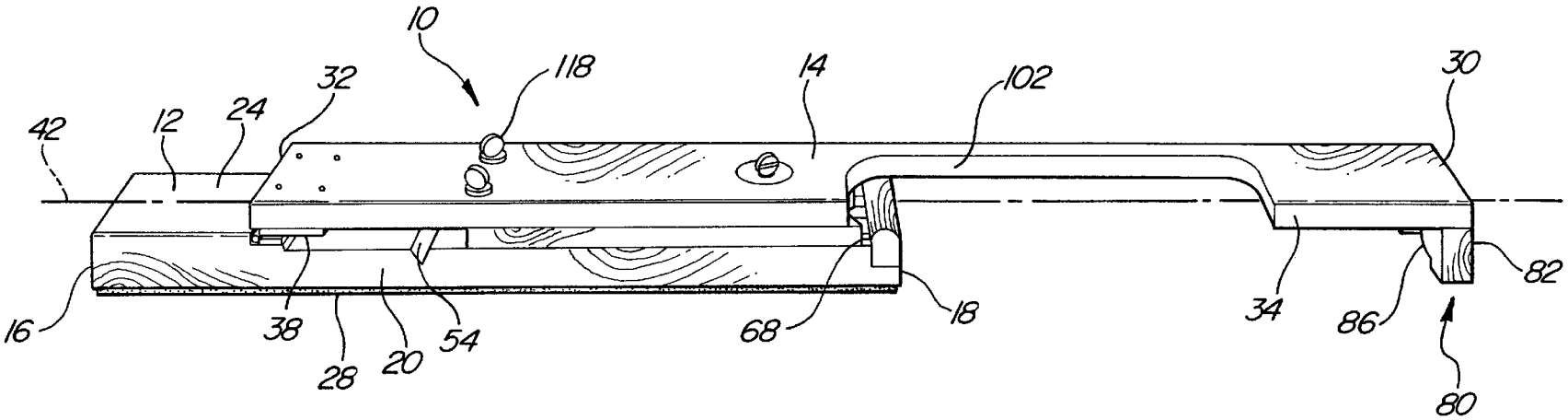
FIG. 4 is a perspective view of the portable bow and long gun holder in a transport position.
Figure 5:
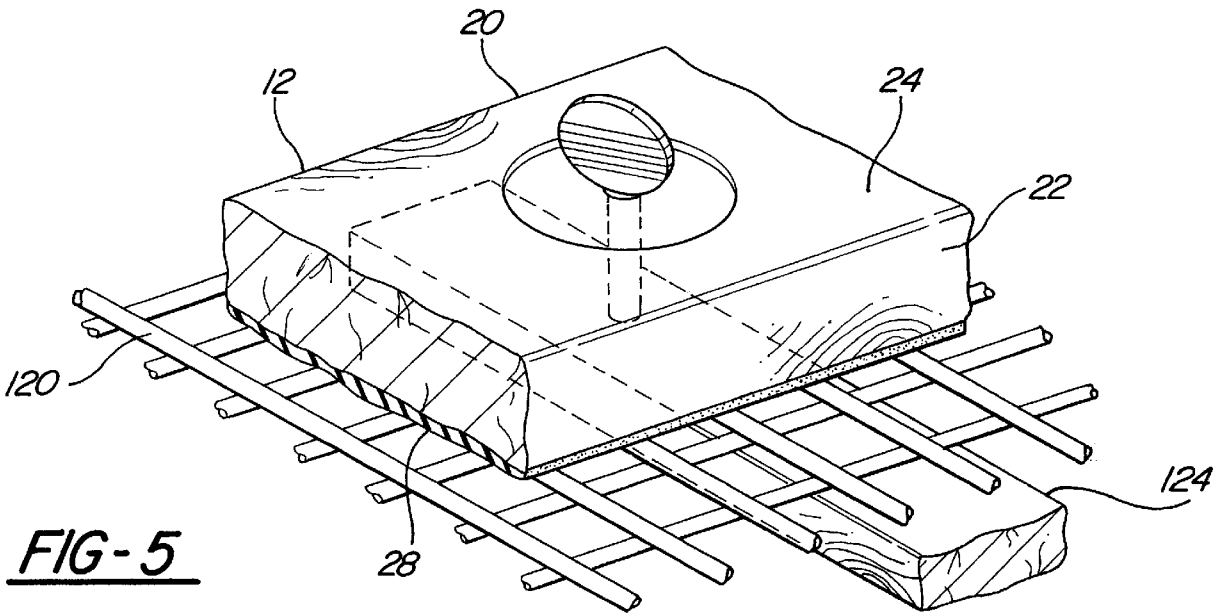
FIG. 5 is an enlarged perspective view of the base plate clamped to the platform of a tree stand with parts broken away.

The portable bow and long gun holder 10 has a base plate 12 and an upright 14. The base plate 12 has a forward end 16, a rear end 18, a left side 20, a right side 22 and a top surface 24. The bottom surface 26 of the base plate 12 is covered by a rubber sheet 28 as shown in FIGS. 4 and 5. The rubber sheet 28 has a high coefficient of friction that resists sliding of the base 12 and also protects the base from moisture.

The upright 14 has an upper end 30, a lower end 32, a left side 34 and a right side 36. A hinge 38 pivotally connects the lower end 32 of the upright 14 to the top surface 24 of the base plate 12 adjacent to the forward end 16. The forward end 16 may extend forward from the upright 14 a short distance as shown to move the center of gravity of a weapon closer to the center of the base plate 12 and improve holder stability. Screws 40 secure the hinge 38 with the hinge axis horizontal and transverse to the fore and after centerline 42 of the base plate 12. The hinge 38 permits the upright 14 to pivot between a weapon support position shown in FIGS. 1, 2, and 3 and a transport position shown in FIG. 4. In the weapon support position, the upright 14 extend vertically upward and at a 90° angle from the bottom surface 26 of the base plate 12. In the transport position, the upright 14 is parallel to the bottom surface 26 as well as the top surface 24 of the base plate 12.

A lock assembly 44 includes an arm 46 that is pivotally attached to the upright 14 by a hinge 48. Screws 50 secure the hinge 48 to the upright 14 and to the arm 46. A free end 52 of the arm 46 is received in a transverse groove 54 in the upper surface 24 of the base plate 12 to lock the upright 14 in the weapon support position. The arm 46 is pivoted upwardly and out of the transverse groove 54 to a position parallel to the upright 14 when unlocked and prepared for transport.

A holder groove 56 in the base plate 12 and an end block 58 form a weapon bottom end holder 60. The holder groove 56 has a floor 62, a left side wall 64, a right side wall 66 that cooperates with a groove end wall surface 68 on the end block 58 to position and retain the lower cams 70 of a compound bow 72 as shown in FIG. 1. The floor 62, the left side wall 64, the right side wall 66 and an end wall upper surface 74 of the weapon bottom end holder 60, cooperate to position and retain the butt 76 of a long gun stock 78 as shown in FIG. 2.

A weapon upper holder assembly 80 includes an upper hold block 82 attached to an upper end 30 of the upright 14 by a screw 84. The upper holder block 82 has a groove with an arcuate left bow engaging surface 86 and an arcuate right bow engaging surface 88 that engage the upper bow spring 90 of a compound bow 72. A left fence 92 and a right fence 94 keep the bow spring 90 from sliding off the left and right arcuate bow engaging surfaces 86 and 88.

The upper holder block also has a gun barrel engaging surface 96. When the portable bow and long gun holder 10 is used to hold a long gun 98 as shown in FIG. 2, the gun barrel 100 rests on the gun barrel engaging surface 96. The left and right arcuate surfaces 86 and 88 function as fences that keep the gun barrel 100 from sliding off the gun barrel engaging surface 96.

An arrow cutout 102 is provided in the left side 34 of the upright 14. The arrow cutout 102 makes it possible for an arrow 104 to be attached to the bow string 106 and to set on an arrow rest while the bow is supported by the portable bow and long gun holder 10 as shown in FIG. 1. Without the arrow cutout 102, an arrow 104 would have to be positioned after the bow 72 is removed from the holder 10. Positioning the arrow 104 on a bow 72 after game is sighted requires excess movement that often alerts the game.

A left handed person needs the arrow cutout 102 on the right side. The change is made by removing screws 50 from the upright 14 and reversing the upright. The upper holder block 82 is also reversed by removing the screw 84, switching the block to the new position and reclamping the block in the new position with the screw. The upper holder block 82 could, if desired, be rotatably attached to the upright 14 and held in either of two positions by a detent if desired. A quick disconnect between the upright 14 and the base plate 12 could also be provided to switch between right handed and left handed use.

When using the portable bow and long gun holder 10 in a hunting blind on the ground, the surface of the ground may be uneven and slope. To accommodate such conditions a pair of outriggers 112 and 114 are clamped to the upright 14 by bolts 116 with wing nuts 118. The outriggers 112 and 114 are pivoted downward until their free ends make firm contact with the ground. The wing nuts 118 are then tightened to hold the base plate 12 in a horizontal position.

The portable bow and long gun holder 10 is clamped to a tree stand 120 as indicated in FIG. 5 by a wing bolt 122 and a bar 124. The wing bolt 122 passes through a bore 126 through the base plate 12, through the platform of the tree stand 120 and screws into the bar 124. Tightening the wing bolt 122 clamps the base plate 12 to an upper horizontal surface of the tree stand.

The portable bow and long gun holder 10 is placed in a transport position by clamping the bar 124 with the wing bolt 122 to the upright 12 as shown in FIG. 2. The free ends of the outriggers 112 and 114 are pivoted upward toward the upper end 30 of the upright 14 and clamped in position by tightening wing nuts 118. The arm 46 of the lock assembly 44 is pivoted upward about the axis of the hinge 48 to a position between the outriggers 112 and 114. The upright 14 is pivoted about the axis of the hinge 48 relative to the base plate 12 until the upright 14 contacts the upper surface 74 of the end block 58. In this position the upright 14 is generally parallel to the bottom 26 of the base plate 14. Steps 130 and 132 in the top surface 24 of the base plate 12 provide space for the outriggers 112 and 114, the arm 14 of the lock assembly 44 and the bar 124. If desired the base plate 12 and the upright 14 can be clamped in the transport position. The transport position provides a relatively small package to carry and to store.

The disclosed embodiment is representative of a presently preferred form of the invention, but is intended to be illustrative rather than definitive thereof. The invention is defined in the claims.

I claim:

1. A portable bow and long gun holder comprising:

a base plate with a forward end, a rear end, a fore and aft center line, and a top surface;

an upright with an upper end, a lower end, a left side, a right side, said left and right sides being on opposite sides of the fore and aft center line of the base plate and an arrow cutout in the left side of the upright;

a hinge pivotally attaching the lower end of the upright to said base plate adjacent to the forward end of the base plate and wherein the upright is pivotal between a weapon support position and a transport position generally parallel to said base plate;

a weapon bottom end holder on the rear end of said base plate having a pair of spaced apart side walls on opposite sides of the fore and aft center line, a floor, and a bottom holder end wall surface that is transverse to the fore and aft center line and faces toward the hinge;

a weapon support holder on the upper end of the upright having a pair of bow engaging surfaces and a gun barrel engaging surface between the pair of bow engaging surfaces; and a lock that releasably holds the upright in the weapon support position.

2. A portable bow and long gun holder as set forth in claim 1 wherein the upright is reversible to move the arrow cutout from the left side to the right side.

3. A portable bow and long gun holder as set forth in claim 1 wherein the lock includes an arm that is pivotally attached to the upright and wherein a free end of the arm engages a groove in said base plate and locks the upright in the weapon support position relative to said base plate.

4. A portable bow and long gun holder as set forth in claim 1 including at least one outrigger that is pivotally attached to the upright for pivotal movement between a storage position and a ground engaging position.

5. A portable bow and long gun holder as set forth in claim 1 including a left outrigger pivotally attached to the upright for pivotal movement between a left outrigger storage position and a left outrigger ground engaging position, and a right outrigger pivotally attached to the upright for pivotal movement between a right outrigger storage position and a right outrigger ground engaging position.

6. A portable bow and long gun holder as set forth in claim 1 including a threaded fastener that passes through a bore through said base plate and a tree stand clamp bar in engagement with the threaded fastener.

7. A portable bow and long gun holder comprising:

a base plate with a forward end, a rear end, a fore and aft centerline, and a top surface;

an upright with an upper end, a lower end, a left side, an arrow cutout in the left side and a right side;

a hinge pivotally attaching the lower end of the upright to said base plate adjacent to the forward end of the base plate and wherein the upright is pivotal about a hinge axis that is horizontal and transverse to the fore and aft center line between a weapon support position, in which the upper end of the upright is spaced from said base plate a distance substantially equal to a length of the upright, and a transport position in which the upright is substantially parallel to said base plate;

a weapon bottom end holder on the rear end of said base plate having a pair of spaced apart side walls on opposite sides of the fore and aft center line, a bottom holder end wall surface that is transverse to the fore and aft center line and faces toward the hinge, a bottom holder end wall upper surface that faces away from said base plate and a weapon bottom end holder floor;

a weapon upper holder secured to the upper end of the upright having a pair of spaced apart bow engaging surfaces and a gun barrel engaging surface between the pair of spaced apart bow engaging surfaces; and a lock that releasably holds the upright in a weapon support position.

8. A portable bow and long gun holder employment method comprising:

mounting an upright on a base plate, having a forward end, a rearward end, and opposite sides, in a position which places an arrow cutout on the upright facing the desired side of said base plate;

pivoting the upright relative to the base plate from the rearward end to the forward end and from a transport position where the upright is generally parallel to the base plate to a weapon support position via a hinge connecting the base and the upright;

locking the upright in the weapon support position;

positioning the base plate on a surface in a hunting area;

supporting a weapon lower end on a weapon bottom end holder on the base plate; and resting an upper weapon portion on a weapon upper holder secured to the upright.

9. A portable bow and long gun holder employment method as set forth in claim 8 including:

clamping a left outrigger to the upright in a position in which the left outrigger engages the ground; and clamping a left outrigger to the upright in a position in which the right outrigger engages the ground.

10. A portable bow and long gun holder employment method as set forth in claim 8 including:

clamping the base plate to a generally horizontal surface.

11. A portable bow and long gun holder comprising:

a base plate with a forward end, a rear end, a fore and aft center line, and a top surface;

an upright with an upper end, a lower end, a left side, a right side, an arrow cutout in the left side of the upright and wherein the upright is reversible to move the arrow cutout from the left side to the right side;

a hinge pivotally attaching the lower end of the upright to said base plate adjacent to the forward end of the base plate and wherein the upright is pivotal between a weapon support position and a transport position generally parallel to said base plate;

a weapon bottom end holder on the rear end of said base plate having a bottom holder end wall surface that is transverse to the fore and aft center line and faces toward the hinge;

a weapon support holder on the upper end of the upright having a bow and a gun barrel engaging surface; and a lock that releasably holds the upright in the weapon support position.

* * * * *

UNITED STATES PATENT AND TRADEMARK OFFICE

CERTIFICATE OF CORRECTION

PATENT NO. : 6,457,685 B1
DATED : October 1, 2002
INVENTOR(S) : John F. Taylor

It is certified that error appears in the above-identified patent and that said Letters Patent is hereby corrected as shown below:

Column 6,
Line 15, change “left” to -- right --.

Signed and Sealed this

Fourth Day of March, 2003

JAMES E. ROGAN
*Director of the United States Patent and Trademark Office*